US006159319A

United States Patent [19]

Mossbeck

[11] Patent Number: 6,159,319

[45] Date of Patent: Dec. 12, 2000

[54] METHOD AND APPARATUS FOR FORMING POCKETED COIL SPRING MATTRESSES

[75] Inventor: Niels S. Mossbeck, Dayton, Tenn.

[73] Assignee: L&P Property Management Company, South Gate, Calif.

[21] Appl. No.: 09/160,249

[22] Filed: Sep. 25, 1998

Related U.S. Application Data

[63] Continuation-in-part of application No. 08/639,977, Apr. 29, 1996, Pat. No. 5,885,407.

[51] Int. Cl.[7] ..... B30B 15/04

[52] U.S. Cl. ..... 156/182; 156/297; 5/720; 267/92; 53/114

[58] Field of Search ..... 156/297, 301, 156/300, 556, 182; 5/720, 655.8, 721; 267/91, 92, 96; 53/114

[56] References Cited

U.S. PATENT DOCUMENTS

| | | | |
|---|---|---|---|
| 2,296,807 | 9/1942 | Cavaler | 5/353 |
| 2,862,214 | 12/1958 | Thompson et al. | 5/353 |
| 3,633,228 | 1/1972 | Zysman | 5/353 |
| 4,234,983 | 11/1980 | Stumpf | 5/477 |
| 4,401,501 | 8/1983 | Stumpf | 156/367 |
| 4,439,977 | 4/1984 | Stumpf | 53/428 |
| 4,485,506 | 12/1984 | Stumpf et al. | 5/477 |
| 4,566,926 | 1/1986 | Stumpf | 156/165 |
| 4,578,834 | 4/1986 | Stumpf | 5/477 |
| 4,907,309 | 3/1990 | Breckle | 5/477 |
| 4,986,518 | 1/1991 | Stumpf | 267/91 |
| 5,016,304 | 5/1991 | Ryhiner | 5/453 |
| 5,016,305 | 5/1991 | Suenens et al. | 5/477 |
| 5,126,004 | 6/1992 | Suenens et al. | 156/556 |
| 5,127,635 | 7/1992 | Long et al. | 267/91 |
| 5,319,815 | 6/1994 | Stumpf et al. | 5/477 |
| 5,621,935 | 4/1997 | St. Clair | 5/720 |
| 5,637,178 | 6/1997 | Suenens et al. | 156/297 |
| 5,699,998 | 12/1997 | Zysman . | |
| 5,792,309 | 8/1998 | Eto . | |

FOREIGN PATENT DOCUMENTS

| | | |
|---|---|---|
| 0089789 | 9/1983 | European Pat. Off. . |
| 0357912 | 3/1990 | European Pat. Off. . |
| 0985369 | 3/2000 | European Pat. Off. . |
| 1475098 | 2/1967 | France . |
| 2076465 | 10/1971 | France . |
| 4031652 | 4/1992 | Germany . |
| 4040220 | 6/1992 | Germany . |
| 9214732 | 7/1994 | Germany . |
| 29902911 | 6/1999 | Germany . |

*Primary Examiner*—Richard Crispino
*Assistant Examiner*—Sue A. Purvis
*Attorney, Agent, or Firm*—Wood, Herron & Evans, LLP

[57] ABSTRACT

A method and apparatus for forming a mattress having a core formed from a plurality of elongated rows of interconnected coil spring containing fabric pockets, each row having a plurality of spaced apart pockets with a spring encased in each pocket, and having a reinforcing and/or adhesive material between adjacent rows. A first row of spring encased pockets is placed in a tray in a horizontal position and held in the tray by fingers which engage the fabric of the pockets at the ends of each spring, there being a finger at each end of each pocket. An adhesive, if necessary, may be placed on the upper surface of the row. The tray is mounted on a pivotable plate which is then rotated to a vertical position and moved linearly toward a table containing prior rows of the core to bond the row carried in the tray to the last row on the table. The fingers are thereafter removed from the row in the tray and the tray is pushed linearly a further distance to move the core on the table together with the newly bonded row further onto the table. The tray is thereafter moved linearly and rotated back to its initial position.

35 Claims, 8 Drawing Sheets

METHOD AND APPARATUS FOR FORMING POCKETED COIL SPRING MATTRESSES

This is a continuation-in-part of U.S. patent application Ser. No. 08/639,977, filed Apr. 29, 1996, now U.S. Pat. No. 5,885,407, which is incorporated by reference herein.

BACKGROUND OF THE INVENTION

This invention relates to a method and apparatus for forming a pocketed coil spring mattress having a plurality of rows of closed interconnected fabric pockets, the pockets in each row individually encasing a respective spring, the rows being connected to other such rows by a reinforcing and/or adhesive material, and more particularly to a method and apparatus for positioning, holding and bonding the rows of pocketed coil springs to one another.

It is known to place rows of pocketed coil springs in a parallel fashion to create a mattress, inner spring unit or other body support foundation. A known method for making the rows of encased coil springs is to fold the encasing or pocketing material such that there is a crease on one longitudinal side and an opening on the opposite side. Compressed coils are inserted through the opening between the layers of pocketing material and the opening is sealed by a sealing system, such as a thermal sealing system or stitching. The layers of pocketing material are further sealed between each coil. The coils are than turned and expanded such that one end of the coil is facing the crease of the pocketing material and the other end is facing the sealed opening.

The number of coils in a row and the number of rows are dependent upon the coil spring diameter and the desired finished size of the mattress or the like. The construction of the mattress core may be a plurality of rows of parallel coils with the coils aligned in columns so that the coils line up in both longitudinal and lateral directions, or they may be nested in a honeycomb configuration wherein coils in one row are off-set from coils in the adjacent row.

It is known to connect the rows of coils in a coil to coil manner illustrated in Stumpf U.S. Pat. Nos. 4,566,926 and 4,578,834, and Suenens et al. U.S. Pat. Nos. 5,016,305 and 5,637,178, each of which are hereby incorporated by reference. Nested constructions where rows of coils are interlocked are illustrated in Stumpf U.S. Pat. No. 5,319,815 and German 4,040,220, each of which are hereby incorporated by reference. Other methods of connecting the rows of coils utilize metal clips known as hog rings or they may be stitched with twine which penetrates each row of coils.

Another method in the prior art is the use of rows of coils positioned in a frame with a web of nonwoven material sprayed on the top and bottom of the pocketed coil units, the spray nozzles being manually controlled. Alternatively, or in addition, to the spraying method, beads of hot melt adhesive may be dispensed onto the top and bottom surfaces of the rows of coils and a sheet of nonwoven material pressed against the adhesive containing surfaces.

In Breckle U.S. Pat. No. 4,907,309, a mattress is disclosed having rows of closed fabric pockets with a coil spring positioned in each pocket, there being a plurality of pockets in each row and the rows being connected transversely relative to the direction of the rows by an elastic connecting wall adhesively bonded between each pair of rows. However, the method for forming the mattress is merely disclosed as applying adhesive to an endless strip of connecting wall and pressing an endless row of pockets onto the strip until the connection is made and hardening has occurred. The combination row is then divided transversely into rows of finite length and each such row is thereafter bonded to other rows.

In Suenens et al. U.S. Pat. No. 5,126,004, which does not utilize a connecting wall between the rows of springs, each row of springs is compressed by a pressure plate to hold and position them so that an adhesively coated row may be pushed against another such row. The use of such a pressure plate causes the pocket material to sag and results in a bulging in the center portion of the springs, which was pointed out earlier by Breckle as being a problem.

A similar pocketed coil spring mattress is disclosed in Long et al. U.S. Pat. No. 5,127,635 but the springs in the pockets in each row are formed from a continuous length of wire so that adjacent springs are interconnected, albeit each pocket contains one to three springs. None of this known prior art, however, is directed toward a method and apparatus for manufacturing a pocketed coil spring mattress consistently of a uniform size and in an efficient and practical manner.

In the prior art processes, control and distribution of the adhesive is difficult and inefficient. Some areas of the row may receive too much adhesive while other areas may not receive a sufficient amount of adhesive. Excess adhesive of course is economically inefficient, while risk of separation of the rows of pocketed coil springs from the nonwoven material may result from too little adhesive. Moreover, when adhesive is sprayed there is a tendency for the spray nozzles to clog so that the flow of glue is obstructed. This results in a time consuming cleaning and maintenance program. Additionally, hot melt spraying requires the system to be heated about one hour before spraying can begin. Other difficulties presented by hot melt spraying and application of beads is that the hoses through which the hot melt flows must be insulated to maintain the temperature of the glue within the hose, thereby resulting in very heavy hoses. Since the spraying process involves manually moving the spray nozzle to which the hose is attached to spray the adhesive, the heavy hoses result in the process being slow and fatiguing to the operators who often encounter minor bums from the glue and the nozzles.

Potential solutions for the above-described disadvantages with respect to the adhesive spraying are disclosed in this inventor's pending U.S. patent application Ser. No. 09/024,536, filed Feb. 17, 1998, and U.S. Provisional Patent Application Ser. No. 60/094,135, filed Jul. 24, 1998, each of which are hereby incorporated by reference in their entirety. In one of those methods, the plurality of rows of pocketed coil springs are placed between top and bottom sheets of nonwoven webs of material, each web having a heat activated reinforcement netting. Thus, the rows are attached at their upper and lower surfaces to the sheets of material, rather than on their side surfaces to an adjacent row. In the other method, the nonwoven web of material with reinforcement is positioned between adjacent rows.

A further problem that exists in some of these prior art processes is wear of the pocketing material at the points at which the coils in adjacent rows rub together. Over time, a hole is worn in the pocketing material, resulting in the metal coils rubbing together. The metal on metal rubbing creates undesirable noise when the mattress is in use. Breckel U.S. Pat. No. 4,907,309, as stated previously, provides a connecting wall made of elastic material between the rows of pocketed coil springs, with the wall being adhesively bonded to the rows. Although this reduces wear of the encasing material, an adhesive must still be manually applied to attach the rows to each other and the elastic material adds complexity and cost to the system and potentially reduces the firmness of the spring assembly.

SUMMARY OF THE INVENTION

The present invention provides an improved spring core, and a method for making the same, having a layer of reinforcing and/or adhesive material between rows of pocketed coil springs, thus serving to adhere the rows to each other and/or to reduce or prevent wear between coils in frictional relation. According to the principles of the present invention, the reinforcing and/or adhesive layer may be added to one or both sides of the pocketing material. Before the rows of pocketed coil springs are assembled in side-by-side relation, an adhesive is applied or the adhesive component of a reinforcing, adhesive material is activated, thereby bonding the rows together. Alternatively, the adhesive component may be activated after the rows are assembled. A feasible and economic method for adhering rows of pocketed coil springs together in a spring core assembly is provided while simultaneously reinforcing the pockets of the coil springs to prevent wear between coils of adjacent rows.

Irrespective of whether the rows of pocketed coil springs are adhered directly one to the other or are adhered with a reinforcing material between the rows, the fabric material within which the coil springs are pocketed is held taut according to the practice of this invention while the adhesive is being applied and/or while each row is added to the spring unit to produce a dimensionally stable spring unit of a uniform dimension. The method comprises: inserting a row of pocket containing springs into a tray in a horizontally disposed position; holding the row in the horizontal position by engaging the fabric of each pocket with oppositely located fingers disposed substantially axially relative to the axis of the coil spring within the respective pocket to maintain the horizontally disposed surfaces of the fabric taut against the coils; applying adhesive if necessary to the upper exterior surface of the fabric; rotating the tray to a vertical position; and moving the tray horizontally to engage the exterior surface against a surface of a previous row on a table while the fabric of the row of pocketed coil springs in the tray remains taut. The fingers are thereafter released from engagement with the fabric, the tray moved further over the table to push the composite rows further on the table in preparation for subsequent rows, and the tray moved back and rotated to its initial position.

To perform the method of the present invention, the apparatus utilizes a tray preferably having a plurality of pocketed coil spring receiving surfaces for supporting a row of coil spring containing fabric pockets and a pair of spaced apart jaws associated with the tray, the jaws having a plurality of fingers and being movable from a position permitting a row of pocketed coil springs to be inserted into the tray to a position wherein the fingers engage the fabric of each pocket at dispositions substantially along the axis of each respective coil, each jaw having fingers aligned with respective fingers of the other jaw so that the fabric is maintained taut while the row of pocketed coil springs is held within the tray. Thereby, dimensional accuracy of the length of the rows and the assembly unit is assured as well as accurate location of the adhesive and the adhesive connection between the rows.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
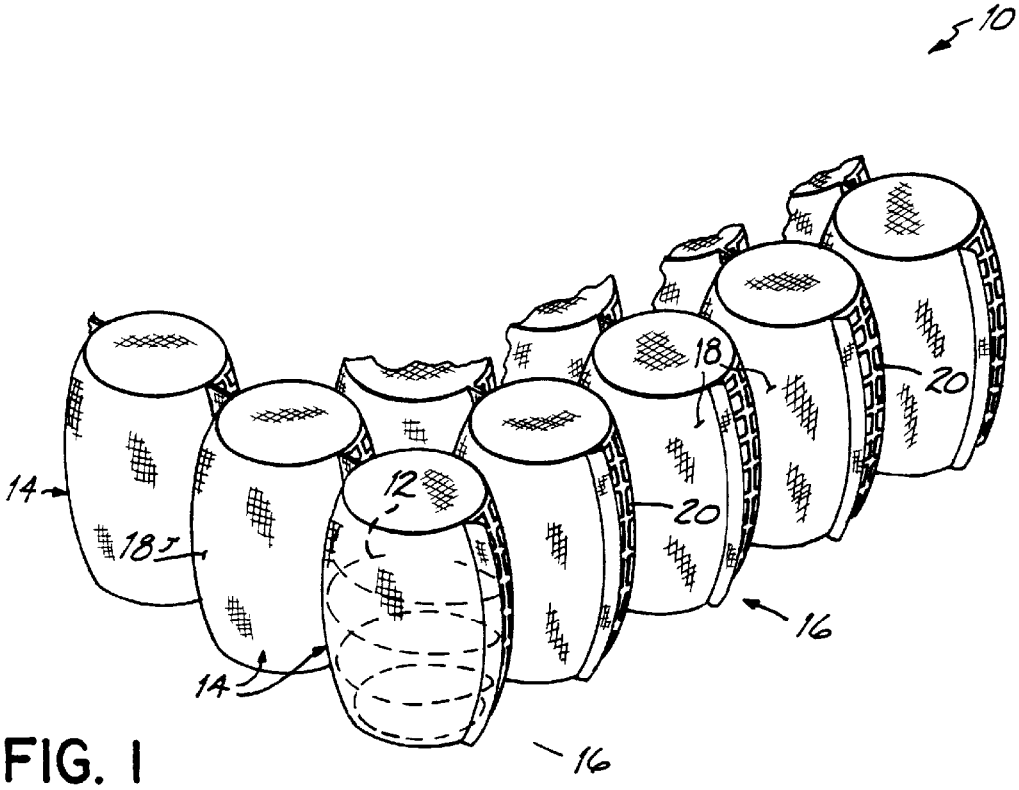
FIG. 1 is a perspective view of a product made by the method of the present invention.

Referring to the drawings, a portion of a pocketed coil spring mattress 10 is illustrated in FIG. 1 wherein coil springs 12 are each depicted positioned within a respective one of a plurality of pockets 14 forming respective rows of pocketed coil springs 16. The pockets 14 forming a row 16 comprise a strip of pocketing material 18, which may be a non-woven or a woven material, of a width somewhat larger than approximately twice the height of each coil spring 12, the strip in one presently preferred embodiment being folded in half to form individual pockets for receiving the coil springs 12. The strip of pocketing material 18 is sewn or thermally sealed between adjacent pockets and along the open unfolded edges after the springs are inserted to lock the springs therein.

Figure 2:
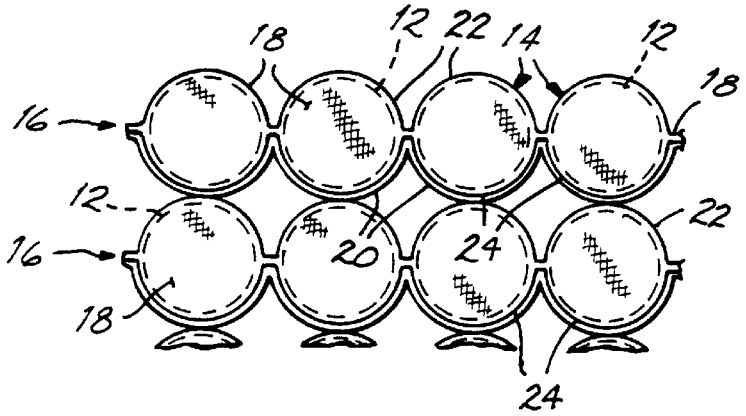
FIG. 2 is a partial top plan view of a core assembly according to the principles of the present invention.

Also illustrated in FIG. 1, and in FIG. 2, is a layer of adhesive and/or reinforcing material 20 between the rows of pocketed spring coils 16 to join the rows together and/or to provide an extra layer between the coils to prevent early wear. A layer of material 20 may be laid upon the outer surface of one of the halves of the strip of pocketing material 18 for forming the pocketed coil springs 16. The adhesive and/or reinforcing material 20 is then secured or thermally sealed to the pocketing material 18. The resulting row of encased coil springs 16, as shown in FIGS. 1 and 2, has on a first side 22 a layer of pocketing material 18, and on a second opposing side 24 a layer of reinforcing and/or adhesive material 20 over a pocketing material 18. To form the mattress core, the rows of pocketed coil springs 16 are aligned in columns with the coils 12 side by side, as shown in FIGS. 1 and 2, or in a honeycomb alignment (not shown), with the second side 24 of one row 16 contacting the first side 22 of the adjacent row 16. Thus, between the rows of coil springs 12 there are two layers of pocketing material 18 and an intervening layer of reinforcing and/or adhesive material 20. Heat or other activating means (not shown) is then applied if necessary to the assembly to activate the adhesive component of the reinforcing and/or adhesive material 20. An adhesive bond is thereby created between the first and second sides 22, 24 of adjacent rows 16.

A reinforcing, adhesive material may be used for material 20 and may be any material with a preprinted pattern of an adhesive, such as glue, or may be a material saturated with an adhesive, or may be a material with an adhesive powder that impregnates the fabric. By way of example, the reinforcing, adhesive material may be a web of nonwoven fabric material reinforced with a heat sensitive mesh netting. One nonwoven material with the reinforced netting is sold under the registered trademark LAMINET® by Conwed Plastics of Minneapolis, Minn. This product includes both the nonwoven material and the heat-actuated adhesive netting, albeit the reinforced heat-actuated netting itself is also sold by this company under the registered trademark THERMANET®. The heat sensitive reinforced mesh or netting is a polypropylene plastic with the adhesive integral with the netting itself so as to form both a bonding agent and a reinforcement for the nonwoven. Furthermore, the web of adhesive may be in a mesh configuration or another known configuration within the scope of this invention.

The activating means (not shown) for the adhesive component may be an oven operated at temperatures high enough to melt the adhesive component, but low enough to prevent the reinforcing material and pocketing material 18 from melting or burning. For example, the adhesive web on the LAMINET® product has a tack temperature of approximately 180° F. to 212° F. and a melt temperature between 200° F. and 284° F. Thus, the oven may be operated at a temperature of about 225° F. to effectively activate the adhesive component for bonding to the adjacent row of pocketed spring coils. Alternatively, the activating means may be a heat lamp or a radiation emitting device.

Use of an inexpensive reinforcing material between the rows of the pocketed coil springs 16 additionally allows for a less expensive material to be used as the pocketing material 18, thus lowering the overall cost for producing a complete core assembly. The reinforcing and/or adhesive material 20 may be the reinforcing, adhesive material discussed above, and shown in FIG. 1, or may be a reinforcing, nonadhesive material. In the case of a nonadhesive material, which could be the same material used for the pocketing material 18 or any other flexible material, other methods for joining the rows of pocketed coil springs together may be used, such as that described in applicant's pending U.S. application Ser. No. 09/024,536, hereby incorporated by reference. In either case, a cost savings may be realized for assembling a core that is superior to previous core assemblies.

The reinforcing and/or adhesive material 20 may also be an adhesive only. The adhesive, for example, may be applied by any method known in the art, such as hot melt spraying, or may be a layer of THERMANET®, as described above.

Figure 3:
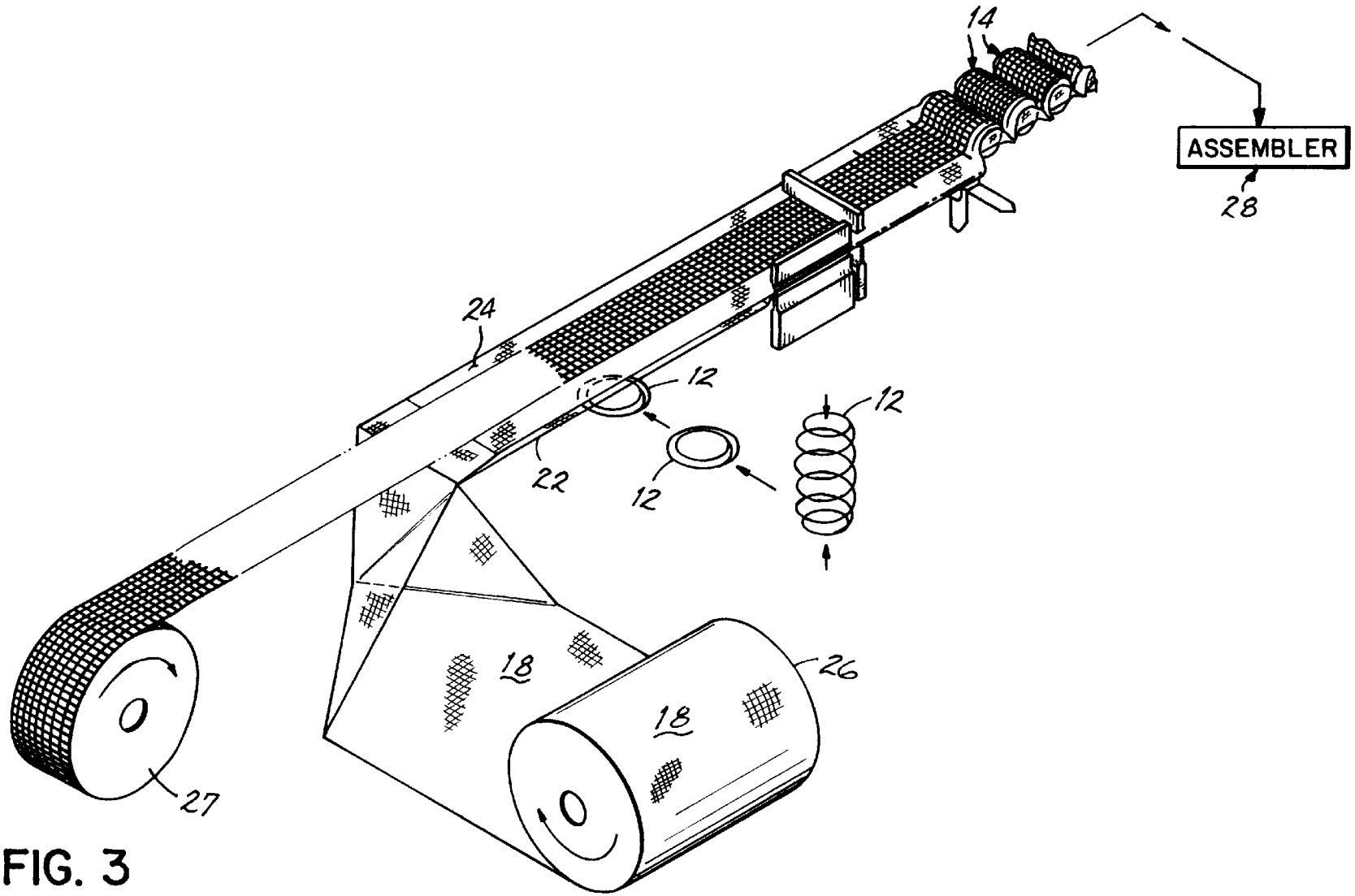
FIG. 3 is a perspective view of a schematic representation of a method for producing rows of pocketed coil springs with a reinforcing, adhesive layer.
Figure 4:
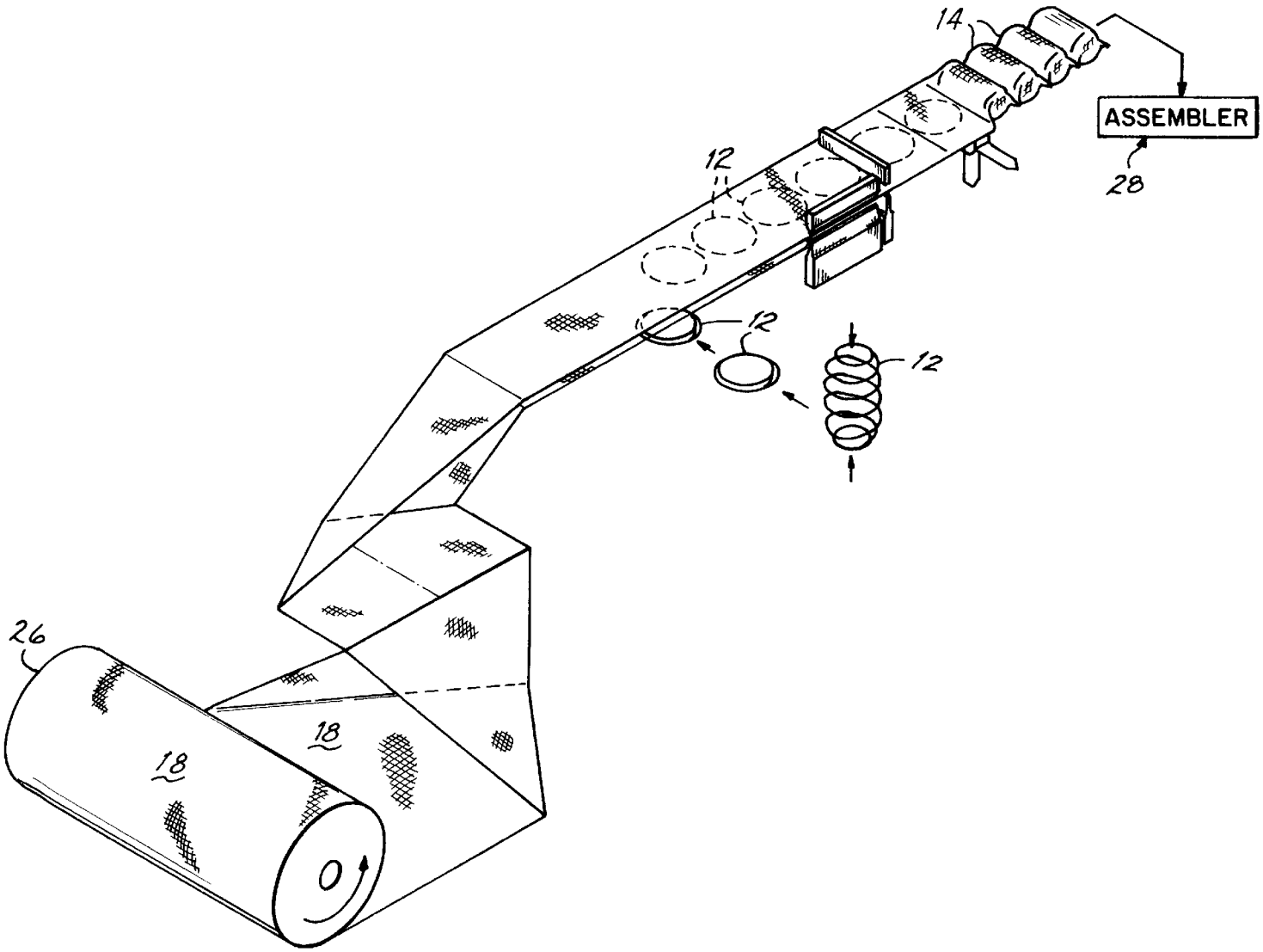
FIG. 4 is a perspective view of a schematic representation of an alternative method of the present invention for producing rows of pocketed coil springs with a reinforcing, nonadhesive layer.

Referring to FIGS. 3 and 4, there is illustrated two alternative methods for manufacturing reinforced pocketed coil springs into rows which may be assembled into cores for use in mattresses or the like according to the principles of the present invention. As illustrated in FIG. 3, there is a first supply roll 26 about which the pocketing material 18 is disposed and a second supply roll 27 about which a reinforcing, adhesive material is disposed. The process is carried out as described above with respect to the prior art, but the layer of reinforcing, adhesive material is placed upon the outer surface 24 of the pocketing material 18 prior to the strip of material being sewn or thermally sealed to form the pockets. After the pockets are formed, the rows of pocketed coil springs 16 are transferred to an assembling apparatus of the present invention for constructing the core of the mattress, as described below.

In an alternative embodiment of the present invention (not shown), a third supply roll about which is disposed reinforcing, adhesive material is added to the system of FIG. 3, such that the reinforcing, adhesive material is applied to the other outer surface 22 of the pocketing material 18. Thus, both the first and second sides 22, 24 of the rows of pocketed coil springs 16 have a layer of reinforcing, adhesive material over a pocketing material 18, and between the rows of coil springs 16 there are two layers of pocketing material 16 and two intervening layers of reinforcing material.

Illustrated in FIG. 4, the pocketing material 18 is folded to have three plies, instead of two, such that after the coils 12 are inserted, the one side has a single layer of material 18 and the other side has a double layer of material 18. This provides the needed reinforcement between the coils in adjacent rows in a manner that is cost effective. This also eliminates the need for a second supply roll to be added to the equipment for providing the reinforcing material. The top and bottom sheets of adhesive material as described in the applicant's pending U.S. application Ser. No. 09/024,536 could then be used to join the rows of pocketed coil springs together, as could other prior art methods described herein or known to those skilled in the art.

Figure 5:
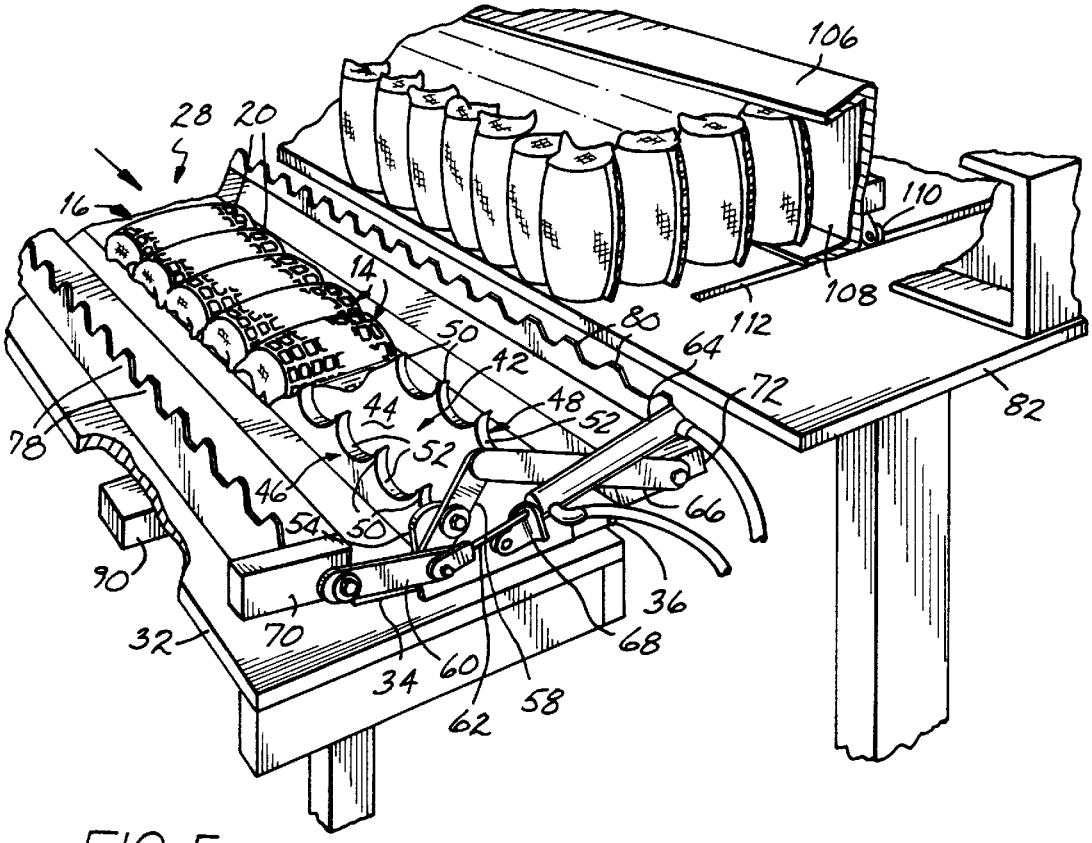
FIG. 5 is a fragmentary perspective view of a portion of the apparatus of the present invention.

An illustrative embodiment of an assembling apparatus of the present invention for constructing the core of the mattress is given in FIG. 5. The assembling apparatus comprises a first station 28 and a second station 30. A table 32 at the first station 28 pivotally mounts a plate 34 to permit the plate to pivot about hinges 36 spaced along the table. One or more piston rods 38, illustrated in FIG. 6, driven by respective cylinders 40 or other force applying means, are connected to the plate 34 in central portions extending upwardly through respective openings in the table 32 to pivot the plate 34 selectively about the hinges 36. Secured to the plate 34 is an elongated tray 42, the tray having a central portion 44 and a pair of oppositely disposed spaced apart elongated teeth-like sides 46, 48, the spacing being substantially equal to the length of a coil in a pocket. Each side 46, 48 carries a plurality of spaced apart projections 50 connected together by concave surfaces 52 of substantially circular or semi-circular form. The projections 50 on the side 46 are aligned with those of the side 48 so that a row of pocketed spring coils may be positioned in the tray 42 with the individual pockets supported snugly on the surfaces 52 in the opposite sides 46, 48, as illustrated in FIG. 5. The surface of the tray 42 may, if desired, also have a concave rising and falling surface for receipt of the pocketed coil springs. Alternatively and preferably each row 16 has a layer of the reinforcing, adhesive material 20 for bonding the rows 16 together. The adhesive of the material 20 being activated prior to the row 16 being placed in the tray 42 or after the row 16 is in the box 106.

Figure 6:
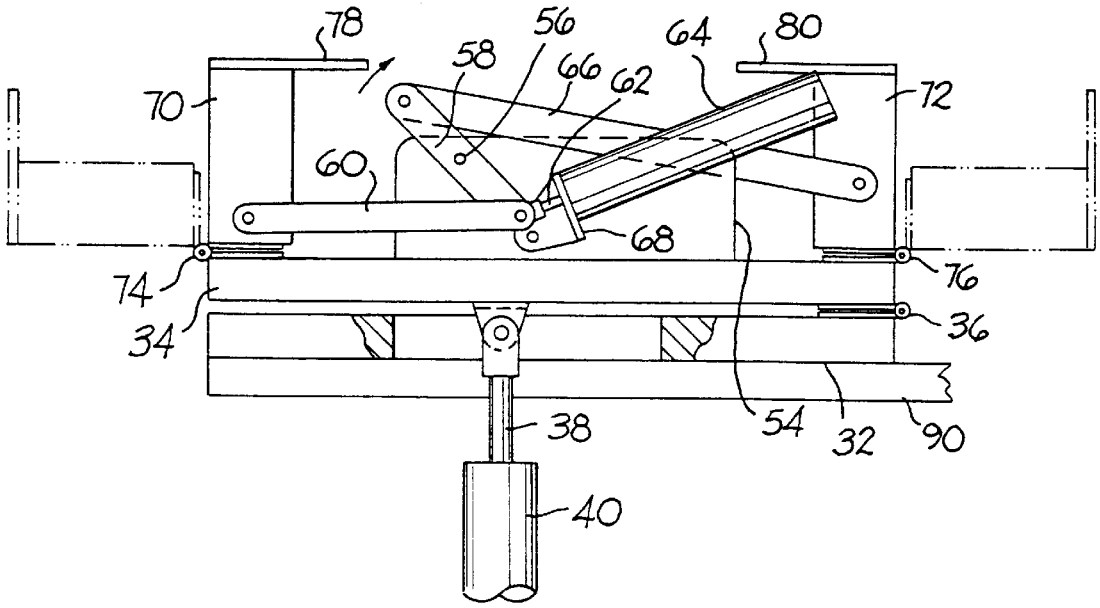
FIG. 6 is a side elevational view partly in section of the tray supporting table illustrating the jaws and the apparatus for actuating the jaws between the open and closed position relative to the tray.

Secured to at least one end, and preferably both ends, of the tray 42 is a bracket 54. Pivotally journalled on the bracket about a journal pin 56 (shown in FIG. 6) intermediate its ends is a link 58 having a first end pivotally connected to a second link 60 and to a coupling on the end of the piston rod 62 of an pneumatic cylinder 64. The other end of the link 58 is pivotally connected to one end of a third link 66. The bracket 54 also journally mounts a small bracket 68 which secures the cylinder 64, the bracket 68 being pivotable slightly when the piston rod is moved. The second end of the link 60 is pivotally connected to the end of a first or outboard jaw 70 while the second end of the link 66 is pivotally connected to the end of a second or inboard jaw 72, each jaw being elongated and extending lengthwise of the table 32. As illustrated in FIG. 6, the jaw 70 is pivotally connected to the plate 34 by hinges 74 spaced lengthwise along the plate while the jaw 72 is pivotally connected to the plate 34 by similar hinges 76.

Figure 7:
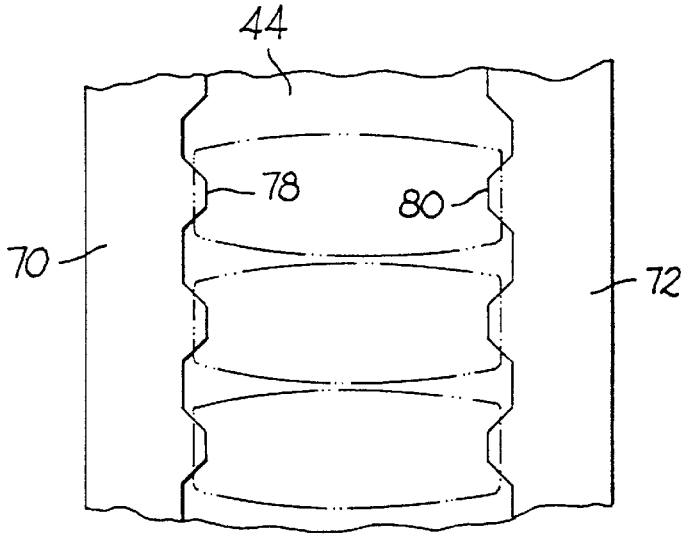
FIG. 7 is a top plan view of a portion of the tray and the jaws of the present invention illustrated in the jaws closed holding position.

Each jaw 70, 72 includes a respective plurality of spaced apart fingers 78, 80 which extend substantially normal to the base of the jaw, i.e., outwardly from the respective jaw and face toward the opposite jaw when the jaws are in the closed or upstanding position illustrated by the solid lines in FIG. 6 and which when the jaws are in the open position, illustrated in FIG. 5 and by the broken lines in FIG. 6, extend upwardly. The fingers 78, 80 may be similar in shape to the projections 50 or may be of a truncated triangular configuration as illustrated in FIGS. 5 and 7, or may be projections of any convenient configuration. Each of the fingers 78 and the fingers 80 are spaced apart in the longitudinally extending direction of the jaws by a distance substantially equal to the distance between the axes of adjacent coil springs 12 in a row of pocketed coil springs. The fingers 78 are aligned oppositely with corresponding fingers 80 to define a pair of cooperating fingers when the jaws are in the closed position and each pair of cooperating fingers are disposed substantially in alignment with the midpoint of the surfaces 52 between the projections 50 of the tray 42. In order to move the jaws 70, 72 to the closed position, illustrated in the solid line position of FIG. 6, the cylinder 64 is actuated to retract the rod 62, and to open the jaws, as illustrated in FIG. 5, the cylinder 64 is actuated to extend the rod 62.

The second station 30 includes a fixed platform or table 82 disposed at an elevation above that of the table 32 by an amount such that when the plate 34 is pivoted to a vertical position relative to the table 32, a row of pocketed coil springs in the tray 42 will have the lower end of the pocketed coil springs at an elevation substantially at the level of the table 82, that lower end of the pocketed coil springs being the end adjacent the table 30 when the plate is in the horizontal position on the table 32. The fingers 78 are aligned oppositely with corresponding fingers 80 to define a pair of cooperating fingers when the jaws are in the closed position, and each pair of cooperating fingers are disposed substantially in alignment with the midpoint of the surfaces 52 between the projections 50 of the tray 42 to pull the fabric or pocketing material 18 taut around the springs 12. In order to move the jaws 70, 72 to the closed position, illustrated in the solid line position of FIG. 6, the cylinder 64 is actuated to retract the rod 62, and to open the jaws, as illustrated in FIG. 5, the cylinder 64 is actuated to extend the rod 62.

Secured to and depending downwardly from the table 82 at the rear thereof remote from the table 32 are a pair of spaced apart brackets 84, only one of which is illustrated in FIGS. 8–14, similar brackets 86 depending downwardly from the table 82 adjacent the front thereof. Each pair of brackets 84, 86 supports a hollow tube 88 of any conventional cross sectional configuration, such as a rectangular configuration, and which extends toward the front of the table 82. Slidably disposed within each tube 88 is a respective rod 90 of substantially the same cross sectional configuration as the tubes 88, the rods 90 extending forwardly under the table 32 and being secured thereto. Thus, the table 32 may be moved linearly toward and away from the table 82 guided by the rods 90 within the tubes 88. Secured to and extending between the rods 90 and secured to and extending between the exterior of the tubes 88 are respective narrow plates 92, 94 from which respective brackets 96, 98 depend downwardly intermediate the length of the plates 92, 94 so as to be substantially centrally disposed transversely beneath the tables 32 and 82. Connected to the bracket 98 is the rod end of a first pneumatic cylinder 100, while the rod end of a second pneumatic cylinder 102 is connected to the bracket 96, the opposite ends of the cylinders 100, 102 being connected together by a connecting member 104. The piston rod of one of the cylinders, such as cylinder 100, has a small stroke while the other cylinder, such as cylinder 102, has a larger stroke, for reasons hereinafter made clear, the small stroke being in the order of approximately one inch while the large stroke preferably being in the order of approximately 3.75 inches in an operative embodiment of the invention. Thus, the table 32 may be moved in two steps relative to the table 82.

Positioned on the table 82 and extending transversely is a slidable box 106 having a rectangular configuration with an open front 108, the opening having a height slightly larger than the height of the pockets and a length slightly longer than the length of the row of pocketed coil springs. The opening 108 in the box has a depth slightly less than the thickness of the pocketed coil springs, i.e., slightly less than the diameter of the coil springs 12 so that a row of pocketed coil springs may be received within the box with the surface of the pockets extending outwardly a small amount as illustrated in FIGS. 8 through 14. The box 106 has slide members or wheels 110 attached to the rear thereof at transversely spaced apart locations and each slide member or wheel is received within a guide slot 112 formed in the top of the table 82 for guiding the box slidably along the table. Thus, when one or both cylinders 100, 102 are actuated to retract the respective piston rods, the box may be moved along the table 82. However, the box is weighted so as to apply a frictional resistance so that it does not move when the first cylinder, i.e., cylinder 100, is actuated for bonding a row of pocketed coil springs to a row which is on the table, but will move when the cylinder 102 is actuated to move the pocketed coil springs on the table including a newly bonded row an amount substantially equal to the thickness or width of one row.

Figure 8:
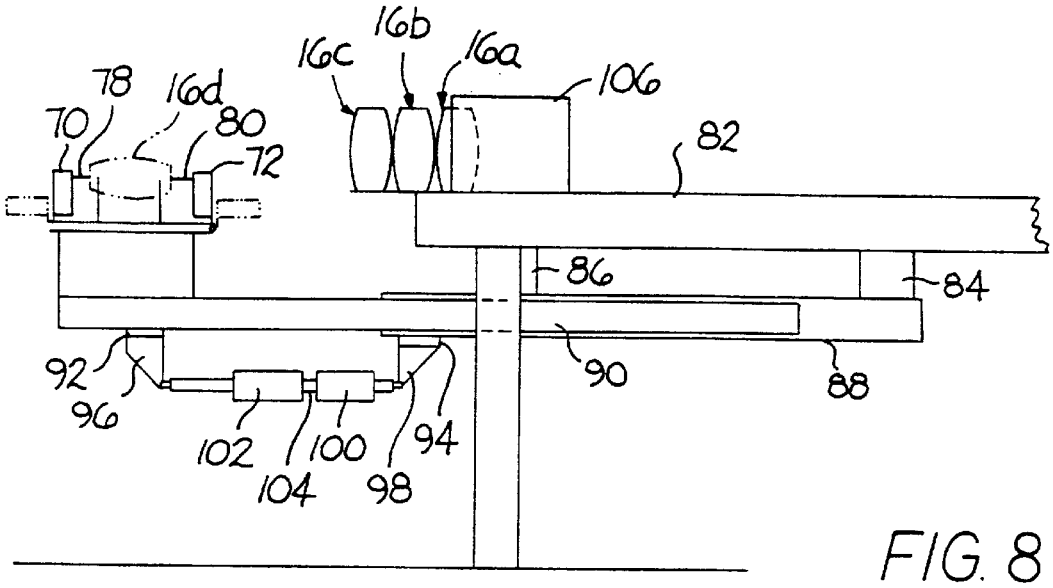
FIGS. 8 through 14 are sequential diagrammatic representations of the apparatus illustrating the various steps in the method of the present invention.

In operation and in practicing the method of the present invention, a row of pocketed coil springs, having between 12 and 26 springs per row depending upon the width of the mattress, is placed on the tray 42 as illustrated in FIG. 5. The cylinder 64 is actuated to withdraw the rod 62 to close the jaws 70, 72 and engage the respective fingers 78, 80 against the fabric at the ends of each coil pocket and thereby lock the row in the tray as illustrated in FIG. 8 with regard to row 16*d* and pull the pocketing material taut without causing sagging of the material along the height or longitudinal surfaces of the pockets. Where an adhesive is needed to bind the rows together, the upper surface of the fabric of the row may be sprayed at this point with the adhesive, such as a hot-melt glue or solvent, or the like. The vertical surface of the last or previous row 16*c* standing on the platform or table 82 outside of the box 106 may also be sprayed with adhesive, if desired. Alternatively and preferably, each row 16 has a layer of the reinforcing, adhesive material 20 for bonding the rows 16 together, the adhesive of the material 20 being activated prior to the row 16 being placed in the tray 42 or after the row 16 is in the box 106.

Figure 9:
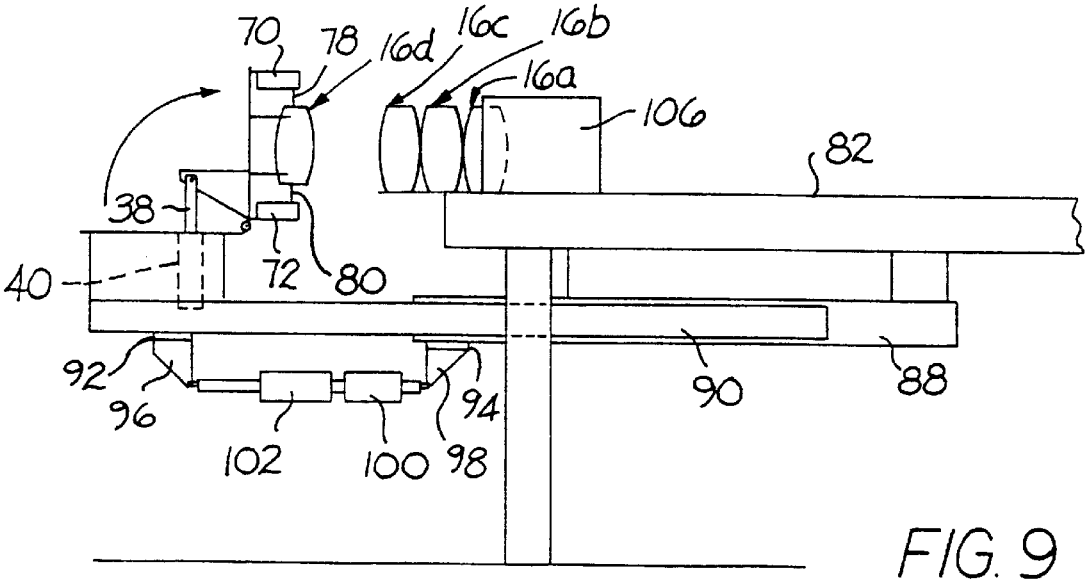
Figure 10:
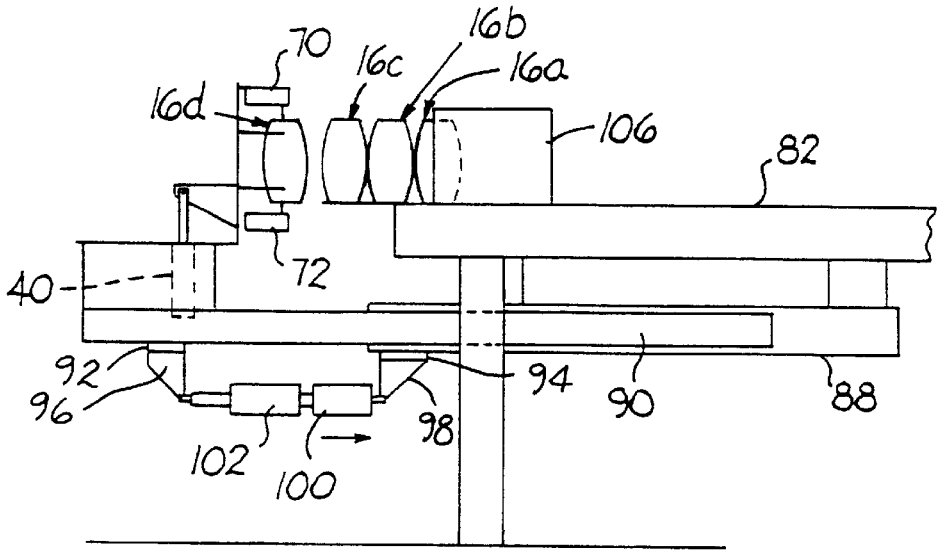
Figure 11:
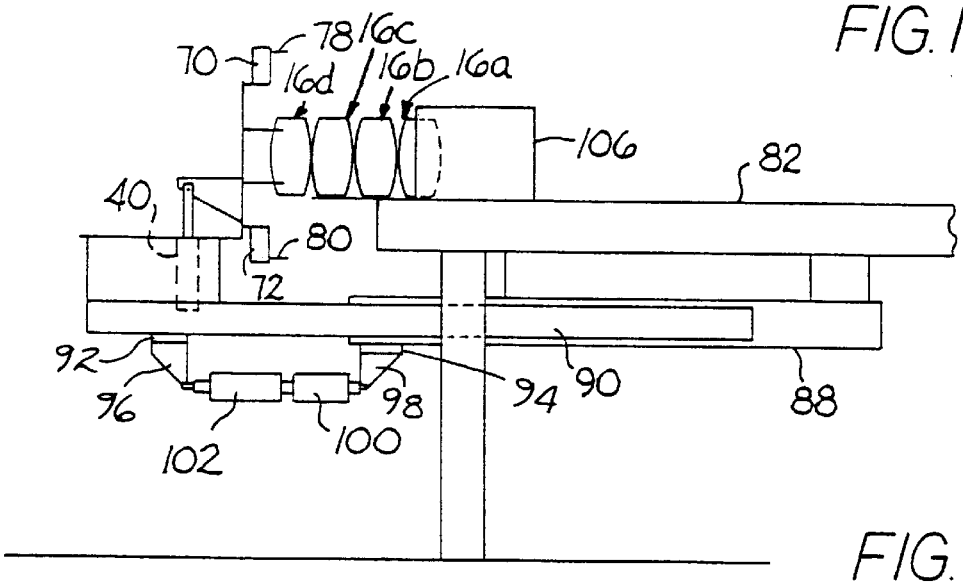
Figure 12:
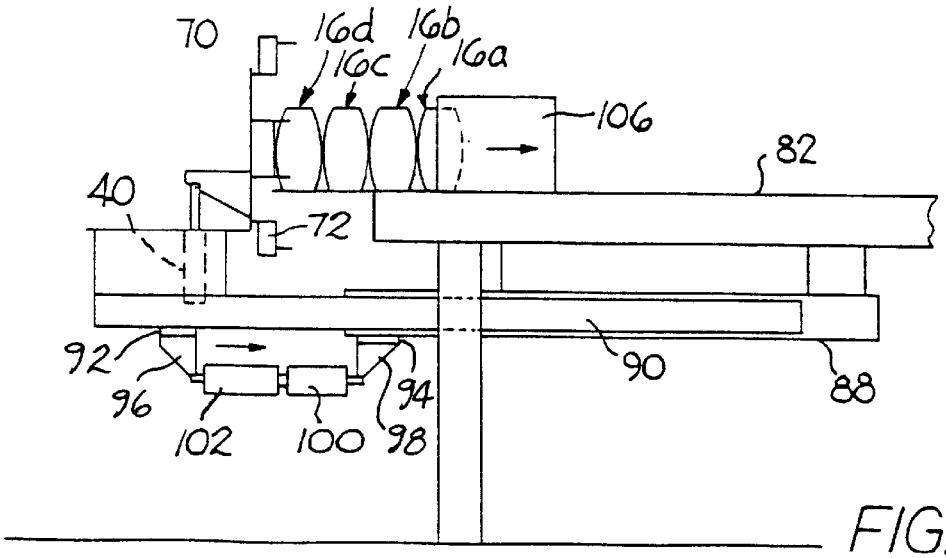
Figure 13:
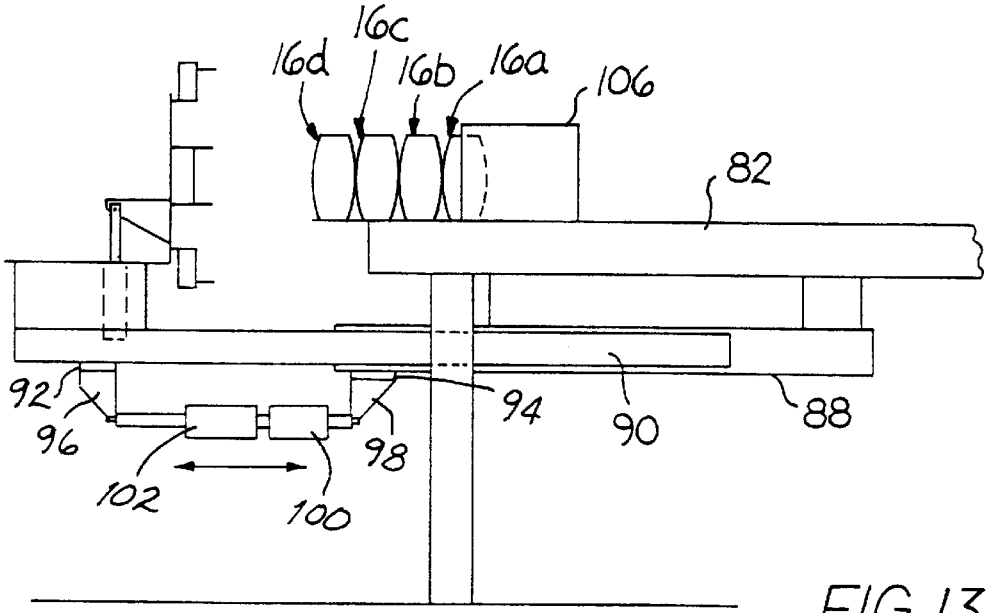
Figure 14:
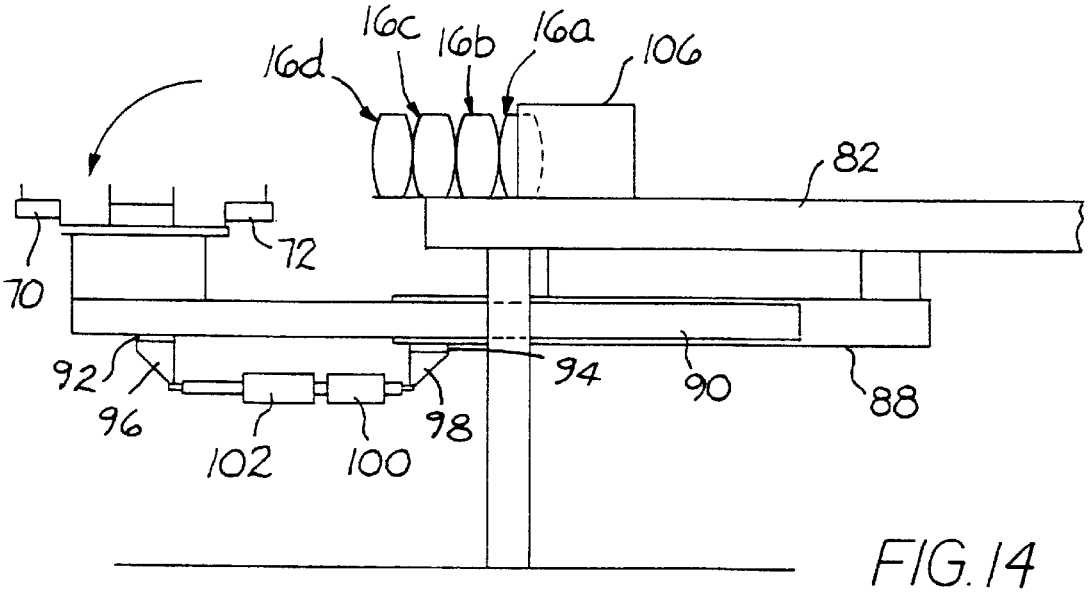

The cylinder 40 is thereafter actuated to extend the rod 38 and thereby pivot the plate 34 to the vertical position illustrated in FIG. 9 to align the row 16*d* vertically with the prior rows 16*a*, 16*b*, 16*c*, the first row 16*a* being disposed partly within the box 106. The cylinder 100 is then actuated to retract its piston rod and drive the table 32 together with the plate 34, the tray 42 and the row 16*d* toward the table 82 and the row 16*c*, as illustrated in FIG. 10, to bond together the pocketed coil springs of row 16*d* to row 16*c*. The cylinder 64 is then actuated to extend the rod 62 and open the jaws 70, 72, as illustrated in FIG. 11, to release the row 16*d* of pocketed coil springs, the row 16*d* being secured to the row 16*c*. The cylinder 102 is then actuated to retract its piston rod and push the bonded rows 16*a*, 16*b*, 16*c*, 16*d* and the box 106 over the table against the friction of the box by a distance of one row, as illustrated in FIG. 12. The cylinders 100 and 102 are then actuated to extend the respective piston rods and move the table 32 together with the plate 34, the tray 42 and the jaws 70, 72 away from the table 82 to its original position, as illustrated in FIG. 13. The cylinder 40 is thereafter actuated to retract its piston rod to lower the plate 34 and tray to the initial position for repetition of the process until the number of rows on the table are substantially equal to the length of the mattress to be formed. Thereafter, the mattress is finished, typically by adding border rods, felt material, cushioning pads and an upholstered covering.

Numerous alterations of the structure herein disclosed will suggest themselves to those skilled in the art. For example, in addition to engaging the row 16*d* with fingers or the like to pull the pocketing material or fabric taut prior to joining the row 16*d* to row 16*c*, the pocketing material or fabric of row 16*c* could also be pulled taut and thereby manufacture an even more dimensionally stable spring unit. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of making a spring core comprising:

encasing a plurality of coiled springs in individual fabric pockets to form a row of pocketed coil springs with opposing outwardly facing surfaces;

juxtaposing a plurality of the rows of pocketed coil springs in side-by-side fashion with longitudinal axes of the springs being generally parallel to one another;

joining the rows of pocketed coil springs together; and pulling the fabric of the pockets of the rows of pocketed coil springs taut around a profile of the coiled springs prior to and during joining the rows together.

2. The method of claim 1 further comprising:

adding a layer of flexible, reinforcing material to at least one of the facing surfaces prior to joining the rows together.

3. The method of claim 1 wherein the joining of the rows is accomplished with adhesive.

4. The method of claim 3 wherein the adhesively joining of the rows is accomplished by adding a layer of material having an adhesive component to at least one of the outwardly facing surfaces.

5. The method of claim 1 wherein the spring core is made by serially joining a single row of pocketed coil springs to an exposed outwardly facing surface of another row of pocketed coil springs.

6. The method of claim 1 wherein the fabric of each of the pockets of the row being joined to the spring core is pulled taut prior to joining the rows together.

7. The method of claim 1 wherein the fabric of the pockets is pulled taut by engaging the fabric with at least one finger to generally conform the fabric to the profile of substantially the entire height of the coil spring within the pocket.

8. A method of making a spring core comprising:

encasing a plurality of coiled springs in individual pockets to form a row of pocketed coil springs with opposing outwardly facing surfaces;

adding a layer of flexible, reinforcing material to at least one of the facing surfaces, wherein the layer of flexible, reinforcing material has an adhesive component;

juxtaposing a plurality of the rows of pocketed coil springs in side-by-side fashion with longitudinal axes of the springs being generally parallel to one another, and with at least one outwardly facing surface of adjacent rows having the layer of flexible, reinforcing material with the adhesive component;

activating the adhesive component and thereby joining the rows of pocketed coil springs together; and pulling the fabric of the pockets taut prior to joining the rows together.

9. The method of claim 8 wherein the spring core is made by serially joining a single row of pocketed coil springs to an exposed outwardly facing surface of another row of pocketed coil springs.

10. The method of claim 8 wherein the fabric of each of the pockets of the row being joined to the spring core is pulled taut prior to joining the rows together.

11. The method of claim 8 wherein the fabric of the pockets is pulled taut by engaging the fabric with at least one finger to generally conform the fabric to the profile of the coil spring within the pocket.

12. A spring assembly manufactured from a method comprising:

encasing a plurality of coiled springs in individual fabric pockets to form a row of pocketed coil springs with opposing outwardly facing surfaces;

juxtaposing a plurality of the rows of pocketed coil springs in side-by-side fashion with longitudinal axes of the springs being generally parallel to one another;

joining the rows of pocketed coil springs together; and pulling the fabric of the pockets of the rows of pocketed coil springs taut around a profile of the coiled springs prior to and during joining the rows together.

13. The spring assembly of claim 12 further comprising:

adding a layer of flexible, reinforcing material to at least one of the facing surfaces prior to joining the rows together.

14. The spring assembly of claim 12 wherein the joining of the rows is accomplished with adhesive.

15. The spring assembly of claim 14 wherein the adhesively joining of the rows is accomplished by adding a layer of material having an adhesive component to at least one of the outwardly facing surfaces.

16. The spring assembly of claim 12 wherein the spring core is made by serially joining a single row of pocketed coil springs to an exposed outwardly facing surface of another row of pocketed coil springs.

17. The spring assembly of claim 12 wherein the fabric of each of the pockets of the row being joined to the spring core is pulled taut prior to joining the rows together.

18. A method of manufacturing a spring unit comprising a plurality of rows of interconnected coil spring containing fabric pockets, each row having a plurality of pockets with a coil spring encased in each pocket, each of said coil springs being coiled in a helical form about an axis of elongation and including opposed ends spaced apart along said axis, the steps comprising:

(a) disposing a first row of interconnected coil spring containing pockets within a support with said axes of said coil springs disposed generally parallel to each other and with a first surface of said row being exposed and a second surface disposed on said support;

(b) engaging the fabric of each pocket of said row with a finger to hold said row in said support and pull the fabric taut to the coil spring in the pocket;

(c) orienting said support to position said axes of said coil springs generally parallel to the axes of coil springs in another row of interconnected coil spring containing pockets;

(d) moving said support to abut said first surface to the fabric of said another row of interconnected coil spring containing pockets;

(e) joining said first row to said another row; and (f) thereafter disengaging the fingers from said first row to release said first row from said support.

19. The method as recited in claim 18, further comprising moving said support in a substantially horizontal direction to push said first and said another rows onto a platform, thereafter removing said support horizontally such that said second surface of said first row is available for abutment to a subsequent row, and rotating said support for receipt of a subsequent row of interconnected coil spring containing pockets.

20. The method as recited in claim 18, comprising the step of applying an adhesive onto said first surface of said row before said support is moved to abut said first surface to the fabric of another row of interconnected coil spring containing pockets.

21. The method of claim 20, wherein each said row is bonded directly to the adjacent row.

22. The method as recited in claim 18, wherein a flexible, reinforcing material is placed on at least the first surface of each said row before said support is moved to abut said first surface to the fabric of another row of interconnected coil spring containing pockets.

23. The method as recited in claim 22, wherein the flexible, reinforcing material has an adhesive component.

24. The method as recited in claim 23, further comprising the step of activating the adhesive component before said support is moved to abut said first surface to the fabric of another row of interconnected coil spring containing pockets.

25. The method as recited in claim 23, further comprising the step of activating the adhesive component after said support is moved to abut said first surface to the fabric of another row of interconnected coil spring containing pockets.

26. The method as recited in claim 18, further comprising the step of applying an adhesive onto said flexible, reinforcing material before said support is moved to abut said first surface to the fabric of another row of interconnected coil spring containing pockets.

27. A method of manufacturing a mattress having a core comprising a plurality of rows of interconnected coil spring containing fabric pockets, each row having a plurality of pockets with a coil spring encased in each pocket, each of said coil springs being coiled in a helical form about an axis of elongation and including opposed ends spaced apart along said axis, the steps comprising:

(a) disposing a first row of interconnected coil spring containing pockets within a support with said axes of said coil springs disposed in a substantially horizontal plane and with a first surface of said row facing substantially upwardly and a second surface disposed on said support;

(b) engaging the fabric of each pocket of said row at each end of a coil spring with a finger to hold said row in said support;

(c) rotating said support to position said axes of said coil springs in a substantially vertical disposition;

(d) moving said support in a substantially horizontal direction to abut said first surface to the fabric of another row of interconnected coil spring containing pockets disposed on a horizontal surface with the axes of the coil springs extending substantially vertical; and (e) thereafter disengaging the fingers from said first row to release said first row from said support.

28. The method as recited in claim 27, further comprising moving said support in said substantially horizontal direction to push said first and said another rows further onto said horizontal surface, thereafter removing said support horizontally such that said second surface of said first row is available for abutment to a subsequent row, and rotating said support for receipt of a subsequent row of interconnected coil spring containing pockets.

29. The method as recited in claim 27, comprising the step of applying an adhesive onto said first surface of said row before said support is moved to abut said first surface to the fabric of another row of interconnected coil spring containing pockets.

30. The method of claim 29, wherein each said row is bonded with the adjacent directly to an adjacent row.

31. The method as recited in claim 27, wherein a flexible, reinforcing material is placed on at least the first surface of each said row before said support is moved to abut said first surface to the fabric of another row of interconnected coil spring containing pockets.

32. The method as recited in claim 31, wherein the flexible, reinforcing material has an adhesive component.

33. The method as recited in claim 32, further comprising the step of activating the adhesive component before said support is moved to abut said first surface to the fabric of another row of interconnected coil spring containing pockets.

34. The method as recited in claim 32, further comprising the step of activating the adhesive component after said support is moved to abut said first surface to the fabric of another row of interconnected coil spring containing pockets.

35. A spring unit comprising a plurality of rows of interconnected coil spring containing fabric pockets, each row having a plurality of pockets with a coil spring encased in each pocket, each of said coil springs being coiled in a helical form about an axis of elongation and including opposed ends spaced apart along said axis, the spring unit manufactured from a method comprising the steps of:

(a) disposing a first row of interconnected coil spring containing pockets within a support with said axes of said coil springs disposed generally parallel to each other and with a first surface of said row being exposed and a second surface disposed on said support;

(b) engaging the fabric of each pocket of said row with a finger to hold said row in said support and pull the fabric taut to the coil spring in the pocket;

(c) re-orienting said support to position said axes of said coil springs generally parallel to the axes of coil springs in another row of interconnected coil spring containing pockets;

(d) moving said support to abut said first surface to the fabric of said another row of interconnected coil spring containing pockets;

(e) joining said first row to said another row; and (f) thereafter disengaging the fingers from said first row to release said first row from said support.

* * * * *

UNITED STATES PATENT AND TRADEMARK OFFICE

CERTIFICATE OF CORRECTION

PATENT NO. : 6,159,319
DATED : December 12, 2000
INVENTOR(S) : Niels S. Mossbeck It is certified that error appears in the above-identified patent and that said Letters Patent is hereby corrected as shown below:

Column 1,
Line 40, "manner illustrated in Stumpf" should read -- manner by applying an adhesive to the encased coils as illustrated in Stumpf --.

Column 2,
Line 40, "minor bums" should read -- minor burns --.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*